United States Patent [19]

Nakagawa et al.

[11] Patent Number: 4,987,452

[45] Date of Patent: Jan. 22, 1991

[54] DEVELOPING APPARATUS PROVIDED WITH A CHAMBER FOR CONTROLLING TONER GRAIN DIAMETER

[75] Inventors: Shuichi Nakagawa; Hiroshi Murasaki; Akihito Ikegawa; Kouichi Etou; Hiroshi Mizuno, all of Osaka, Japan

[73] Assignee: Minolta Camera Kabushiki Kaisha, Osaka, Japan

[21] Appl. No.: 291,120

[22] Filed: Dec. 28, 1988

[30] Foreign Application Priority Data

Dec. 29, 1987 [JP] Japan ..... 62-334026
Dec. 29, 1987 [JP] Japan ..... 62-334027
Dec. 29, 1987 [JP] Japan ..... 62-334028

[51] Int. Cl.[5] ..... G03G 15/06; G03G 15/09
[52] U.S. Cl. ..... 355/245; 355/253
[58] Field of Search ..... 355/245, 246, 251, 253, 355/254, 259, 260; 118/657, 658

[56] References Cited

U.S. PATENT DOCUMENTS 4,350,440 9/1982 Watanabe ..... 355/253
4,468,111 8/1984 Yamagata et al. ..... 355/253
4,615,606 10/1986 Nishikawa ..... 355/253
4,676,192 6/1987 Yuge et al. ..... 355/251
4,786,936 11/1988 Ikegawa et al. ..... 355/253
4,809,034 2/1989 Murasaki et al. ..... 355/253

FOREIGN PATENT DOCUMENTS 0138759 10/1981 Japan ..... 118/658
0283369 12/1987 Japan ..... 355/246

*Primary Examiner*—A. T. Grimley
*Assistant Examiner*—Nestor R. Ramirez
*Attorney, Agent, or Firm*—Burns, Doane, Swecker & Mathis

[57] ABSTRACT

An electrostatic latent image developing apparatus includes an agitating member accommodated in a casing, a roller member accommodated in a front of the casing, and a blade contacting under pressure with an outer circumferential portion of the roller member, which is arranged in the casing. Toner held on the outer circumferential portion of said roller member being supplied to develop an electrostatic latent image on the basis of rotation of the roller member while being regulated by the blade. The apparatus includes a partition member arranged between the roller member and the agitating member at an upper stream side of said blade corresponding to a rotary direction of the roller member. The casing has a space defined among the partition member, the blade, and the outer circumferential portion of the roller member.

23 Claims, 9 Drawing Sheets

DEVELOPING APPARATUS PROVIDED WITH A CHAMBER FOR CONTROLLING TONER GRAIN DIAMETER

BACKGROUND OF THE INVENTION

The present invention generally relates to an image forming apparatus having an electrophotographic copying process and relates to an electrostatic latent image developing apparatus for visualizing an electrostatic latent image formed on the surface of an electrostatic latent image support by supply of developer.

Conventionally, as examples of a developing apparatus, there have been proposed arrangements shown in FIG. 12 as disclosed in Japanese Patent Application Nos. 62-47930 and 62-32047, as shown in FIG. 12. The apparatus 1' has a developing unit 3 at the front of a casing 2 and a toner hopper 4 at the back of the casing 2.

In the developing unit 3, a developing sleeve 5 having a magnetic roller 6 therein is arranged to confront a photosensitive drum 100.

In the toner hopper 4, a toner supplying roller 7 has plural minute irregularities on the outer circumferential portion thereof and is arranged to confront the developing sleeve 5. The agitating members 8 and 9 are accommodated at the rear side of the toner supplying roller 7 in the toner hopper 4. A regulating blade 10 and a toner returning prevention member 11 respectively attached to the casing 2 are contacted under pressure with the toner supplying roller 7 in the upper and lower directions thereof, respectively. The connection between the toner hopper 4 and the developing unit 3 are severed by the toner supplying roller 7, the regulating blade 10 and the toner returning prevention member 11.

According to the above-mentioned developing apparatus 1', toner accommodated in the toner hopper 4 is transferred forwardly on the basis of the rotation of the agitating members 8 and 9. Then, toner positioned at the vicinity of the outer circumferential portion of the toner supplying roller 7 is transferred in a direction as indicated by an arrow while the toner is held in the minute irregularities of the surface of the toner supplying roller 7. Then, part of the toner held on the surface of the toner supplying roller 7 is transferred through the vicinity of the distal end contact portion of the regulating blade 10 to a region confronting the developing sleeve 5. The reminder of the toner is regulated by the distal end portion of the regulating blade 10 to be scrapped off from the surface of the toner supplying roller 7 and is collected in the toner hopper 4.

Toner transferred to the region confronting the developing sleeve 5 is supplied to the surface of the developing sleeve 5 by scraping action of carrier magnetically held on the outer circumferential portion of the developing sleeve 5 and by an electric suction force based on a voltage difference between a developing bias voltage Vb applied to the developing sleeve 6 and a returning bias voltage of alternating current biased a D.C. voltage Vss and an A.C. voltage Vrms respectively applied to the toner supplying roller 7.

Toner supplied to the developing sleeve 5 is mixed with the carrier at the outer circumferential portion of the developing sleeve 5. Thus, developer consisting of mixture of mixed toner with the carrier at a specified rate is prepared and is transferred to a region confronting the photosensitive drum 100 to visualize an electrostatic latent image formed on the surface of the photosensitive drum 100.

In the arrangement of the developing apparatus 1', however, as mentioned above, the distal end of the regulating blade 10 contacts with the outer circumferential portion of the toner supplying roller 7 under pressure, on which the minute irregularities is formed. Thus, excessive toner is scrapped off by the blade 10 to regulate the amount of toner supplied to the developing unit 3.

Accordingly, an average grain diameter of toner supplied to the developing unit 3 relates to the roughness of the minute irregularities formed on the surface of the toner supplying roller 7 and the average grain diameter of toner to be used. But, since there is generally a high probability that toner having small grain diameter is held in the minute irregularities and toner having big grain diameter is scrapped off by the regulating blade 10, toner having small grain diameters has a preference to be consumed. That is, grain diameter of toner to be used is sorted.

Then, when the toner is replenished the toner hopper 4, a preference is firstly given to toner having small grain diameter to be supplied to form a minute image. After that, when toner having big grain diameter becomes to be supplied in accordance with increasing the number of sheets of the paper to be copied, the following problems arise. That is, according to increasing grain diameter of toner, the bigger toner to be supplied becomes, the more the charging property of toner falls. Thus, texture of the image becomes rougher and is caused on the copied paper so that the quality of the image on the copied paper becomes bad.

Hereinbelow, a result of a concrete experiment about the sorting of grain diameter of toner is described.

The experiment was performed as follows: toner having average grain diameter of about 14 μm was inserted into the toner hopper of the developing apparatus 1' as shown in FIG. 12. The grain diameter of toner was measured after each specified number of the copied paper at a measured point B on the surface of the photosensitive drum 100 after passing through the region confronting the developing sleeve 6, a measured point C in the toner hopper 4, and a measured point D on the surface of the toner supplying roller 7 after passing through the vicinity of the distal end of the regulating blade 10, respectively.

The results of the experiment is shown in FIG. 13. As is clear from the drawing in FIG. 13, though the value of the toner average grain diameter measured at the measured point C in the toner hopper 4 was firstly about 14 μm, the value increased in accordance with increasing the number of sheets of the copied paper. And thus the value reached about 16 μm in about 1,000 sheets of the copied papers and about 20 μm in about 2,000 sheets of the copied papers.

The value of the toner average grain diameter measured at the measured point D after passing through the vicinity of the distal end of the regulating blade 10, and the value of the toner average grain diameter measured at the measured point B on the surface of the photosensitive drum 100 were respectively about 12 μm and about 12.5 μm, fewer less than 14 μm which is the value of the average grain diameter of toner firstly inserted into the toner hopper. But, the values increased in accordance with increasing the grain diameter of toner in the toner hopper 4, and thus were respectively about 13.2 μm and about 13.6 μm for 1,000 sheets of the copied papers. Then, the values were respectively about 16.4 μm and about 17 μm for 2,000 sheets of the copied papers, much more than that of average grain diameter of toner firstly inserted into the toner hopper.

Meanwhile, though the qualities of the images on the copied papers were good in 1,000 sheets of the copied papers, the qualities thereof became rougher in 2,000 sheets of the copied papers and fog was found on the copied papers additionally.

Although not shown in FIG. 13, after the number of sheets of the copied papers reached 2,000, new toner having average grain diameter of 14 μm was replenished in the toner hopper 4. After that, a lot of fog was found on several copied papers.

SUMMARY OF THE INVENTION

Accordingly, an essential object of the present invention is to remedy the above-described disadvantages and to provide an improved electrostatic latent image developing apparatus.

In accomplishing these objects, according to one preferred embodiment of the present invention, there is provided an electrostatic latent image developing apparatus which comprises: an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a partition member arranged between said roller member and said agitating member at an upper stream side of said blade corresponding to a rotary direction of said roller member, the casing having a space defined among said partition member, said blade, and the outer circumferential portion of said roller member.

Moreover, in another aspect of the present invention, there is provided an electrostatic latent image developing apparatus which comprises: a roller member accommodated in a front of a casing, said roller member having an outer circumferential portion thereof contacting with toner, and a blade contacting under pressure with the outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a partition member arranged at an upper stream side of said blade corresponding to a rotary direction of said roller member and having an end contacting with the outer circumferential portion of said roller member, the casing having a space defined among said partition member, said blade and the outer circumferential portion of said roller member arranged between said partition member and said blade, and toner held on the outer circumferential portion of said roller member being permitted to flow in said space on the basis of rotation of said roller member, while toner in said space is prevented from flowing out therefrom.

By the arrangement according to the present invention as described above, toner held on the outer circumferential portion of said roller member passes through a first contact region between said roller member and said partition member and reaches said space, on the basis of rotation of said roller member. After the toner transferred into said space is held on the outer circumferential portion of said roller member, an excessive amount of toner is regulated by said blade, so that an excess of the toner is scraped off by said blade at a second contact region between said blade and said roller member. The toner passed through the second contact region is transferred on the basis of rotation of said roller member. Then, if a developing sleeve is arranged between said roller member and a photosensitive drum, as described below, after the toner is transferred to a portion confronting the developing sleeve to be supplied on an outer surface of the developing sleeve, the toner is supplied to an electrostatic latent image formed on an outer surface of the photosensitive drum. On the other hand, toner scraped off from the surface of said roller member at the second contact region is left in the space, and after that, the toner is held on the outer circumferential portion of the roller member to be successively supplied to development again. Toner in the space is blocked with said partition member so as not to flow out from the space through the vicinity of the end of said partition.

In another preferred embodiment of the present invention, there is provided an electrostatic latent image developing apparatus which comprises: an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a first partition member and a second partition member respectively arranged between said roller member and said agitating member, said first partition member having a free end at an upper end thereof, and said second partition member having elasticity and including an upper end fixed to an upper portion of the casing and a free end at a lower portion thereof which extends lower than the upper portion of said first partition member at a roller member side of said first partition member.

By the arrangement according to the present invention as described above, a space is formed at the rear of said roller member by said first and second partition members. Toner in the space is held on the outer circumferential portion of said roller member on the basis of rotation of said roller member. Then, part of the toner passes through the vicinity of the end of said blade and is supplied to development. At that time, the toner regulated by said blade and scraped off from the outer circumferential portion of the roller member is left in the space. At the rear of said first and second partition members, toner accommodated into the casing is forwardly transferred by said agitating member. Then, the toner is inserted into the space through a gap between said first and second partition members by said agitating member. When a lot of toner is held in the space, since the space between said roller member and said second partition member is choked up with toner, the region of displacement of an end of said second partition member becomes smaller and the gap is barely formed between said first and second partition members, so that a small amount of toner is inserted into the space. Therefore, the apparatus prevents excessive amount of toner from being inserted into the space. On the other hand, when a small amount of toner is held in the space, since there is a small amount of toner held in the space between said roller member and said second partition member, the region of displacement of the end of said second partition member becomes bigger and the size of the gap formed between said first and second partition members becomes bigger according to rotation of said agitating member, so that a lot of toner is replenished into the space. Furthermore, by means of a bias force based on rotation of said agitating member, said second partition member deforms towards said roller member so that toner positioned between said second partition member and said roller member is pressed on the outer circumferential portion of said roller member to increase toner holding force of said roller member.

In another preferred embodiment of the present invention, there is provided an electrostatic latent image developing apparatus which comprises: an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising an elastic partition member arranged between the roller member and the agitating member and having an upper end thereof fixed to the casing and a lower end which is a free end divided into strips.

In another preferred embodiment of the present invention, there is provided an electrostatic latent image developing apparatus which comprises: an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a first partition member and a second partition member respectively arranged between said roller member and said agitating member, said first partition member having a free end at an upper end thereof, and said second partition member having elasticity and including an upper end fixed to an upper portion of the casing and a free end at a lower portion thereof which extends lower than the upper portion of said first partition member at a roller member side of said first partition member and is divided into strips.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
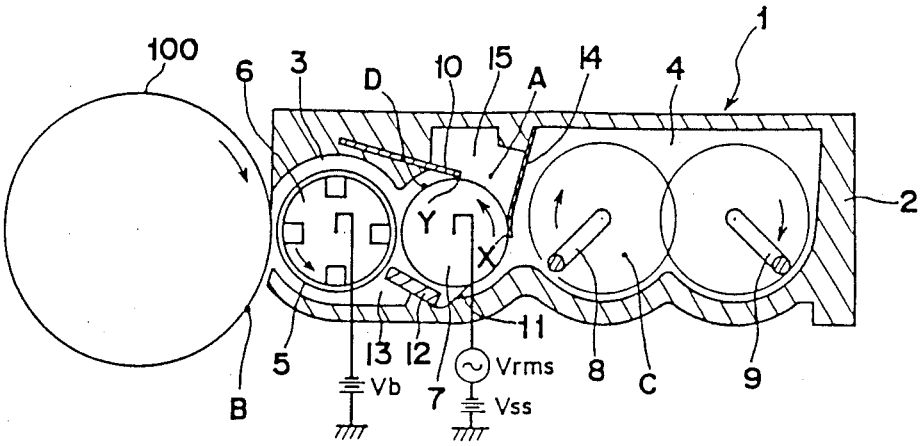
FIG. 1 is a cross-sectional view of a developing apparatus according to one preferred embodiment of the present invention.

Before the description of the present invention proceeds, it is to be noted that like parts are designated by like reference numerals and symbols throughout the accompanying drawings.

FIG. 1 shows the first embodiment of an electrostatic latent image developing apparatus according to the present invention. The apparatus 1 is so constructed that, in the apparatus 1' shown in FIG. 12, a partition member 14 made of elastic material is arranged at the rear of the toner supplying roller 7, the upper end of a partition member 14 being fixed to the upper of the casing 2, the free end of the lower of the partition member 14 contacting with the outer circumferential portion of the toner supplying roller 7, a space 15 being formed at the upper of the toner supplying roller 7 among the partition member 14, the regulating blade 10 and the outer circumferential portion of the toner supplying roller 7.

The contact pressure of the partition member 14 applied against the toner supplying roller 7 is so adjusted that most of toner held on the surface of the toner supplying roller 7 passes without being blocked by the partition member 14 at a contact region X thereof, where the distal end of the partition member 14 contacts with the outer circumferential portion of the toner supplying roller 7, and toner in the space 15 is prevented from flowing out towards the rear of the partition member 14.

Figure 12:
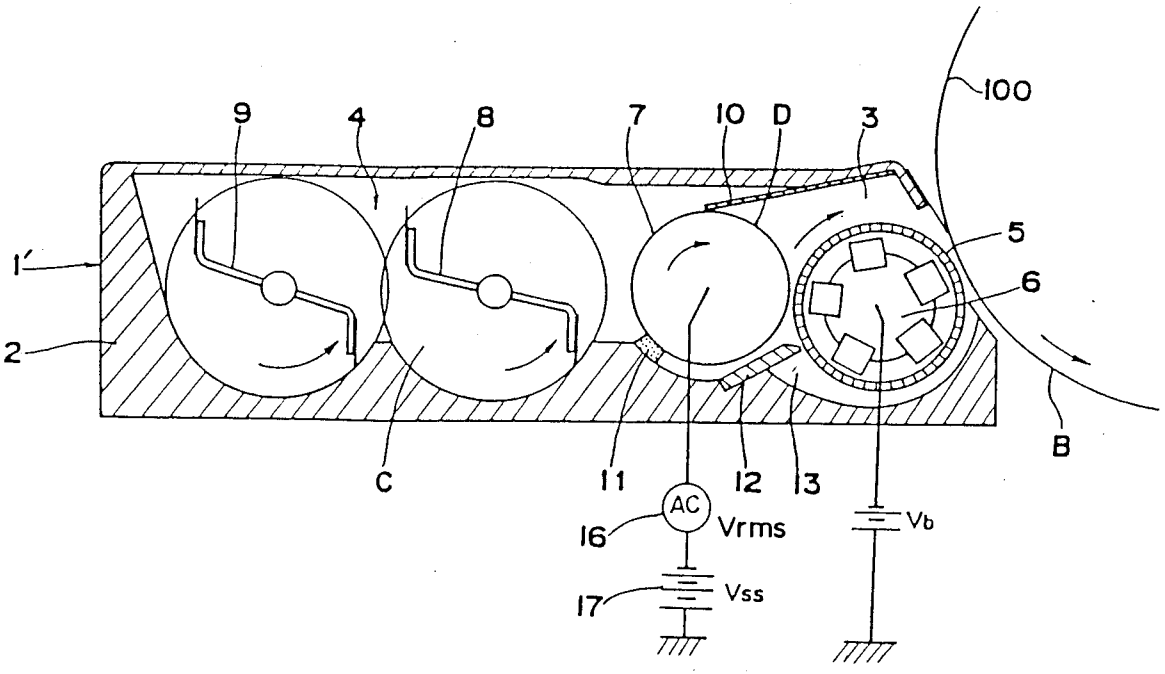
FIG. 12 is a cross-sectional view of a conventional developing apparatus.
Figure 13:
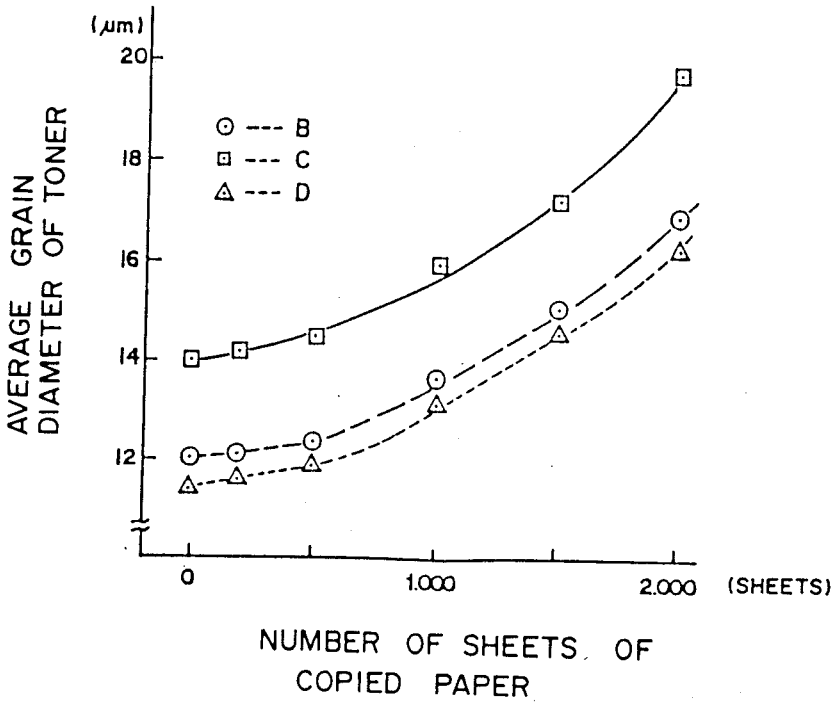
FIG. 13 is a graph of the relation between the number of sheets of copied paper and the average grain diameter of toner, according to the apparatus shown in FIG. 12.

Since the other construction of the developing apparatus 1 is the same as the developing apparatus 1' shown in FIG. 12, it is to be noted that like parts are designated by like reference numerals and symbols throughout the accompanying drawings to omit the description.

In the apparatus 1 according to the above-mentioned construction, toner held on the surface of the roller 7 is transferred to the space 15 through the contact region X of the partition member 14 on the basis of rotations of the toner supplying roller 7 and the agitating members 8 and 9.

Toner transferred to the space 15 is continuously transferred on the basis of the rotation of the roller 7, and toner regulated by the regulating blade 10 at a contact region Y thereof, where the regulating blade 10 contacts with the outer circumferential portion of the toner supplying roller 7, is left in the space 15.

An electrostatic force based on a voltage difference between a developing bias voltage Vb applied to the developing sleeve 6 and a returning bias voltage of alternating current biased both a D.C. voltage Vss and an A.C. voltage Vrms respectively applied to the toner supplying roller 7, and a scraping action of carrier magnetically held on the outer circumferential portion of the developing sleeve 5 are applied at a region confronting the developing sleeve 5 to toner passed through the contact region Y of the regulating blade 10 for supplying to the outer circumferential portion of the developing sleeve 5.

Toner supplied to the surface of the developing sleeve 5 is mixed with carrier to be transferred together, they are mixed and agitated in an agitating chamber 13. After that, developer consisting of mixture of toner mixed with carrier at a specified ratio is held on the surface of the developing sleeve 5 which is passed through a portion confronting an agitating member 12. Then, after toner is replenished to the developer at a portion confronting the toner supplying roller 7, the developer is transferred to a portion confronting the photosensitive drum 100 and is supplied to an electrostatic latent image formed on the surface of the drum 100.

On the other hand, toner regulated and held by the space 15 is held on the outer circumferential portion of the toner supplying roller 7 at a high probability again. After that, some of the developer passes through the contact region Y of the regulating blade 10 to be supplied to the outer circumferential portion of the developing sleeve 5 as described above. Others of the developer is regulated by the regulating blade 10 to be left in the space 15 again. The same operation as described above is repeated hereafter. However, toner in the space 15 is prevented from flowing out towards the rear of the partition member 14 through the contact region X of thereof.

During the developing operation as described above, the sorting of grain diameter of toner transferred to the space 15 is performed at the contact region Y of the regulating blade 10, so that there is a high probability that the smaller the grain diameter of toner becomes, the more the toner passes through the contact region Y to be supplied for use for development. Therefore, toner having big grain diameter is gradually collected in the space 15, so that the average grain diameter of toner therein becomes bigger.

Then, as the average grain diameter of toner in the space 15 becomes bigger, the grain diameter of toner passing through the distal end of the regulating blade 10 becomes bigger. Finally, the grain diameter of toner passing therethrough becomes the same value as the average grain diameter of toner transferred to the space 15. Then, the average grain diameter of toner to be used for development is balanced with that of toner to be transferred to the space 15. Thus, toner having the same distribution of grain diameter thereof as that of toner in the toner hopper 4 is used for development.

Figure 2:
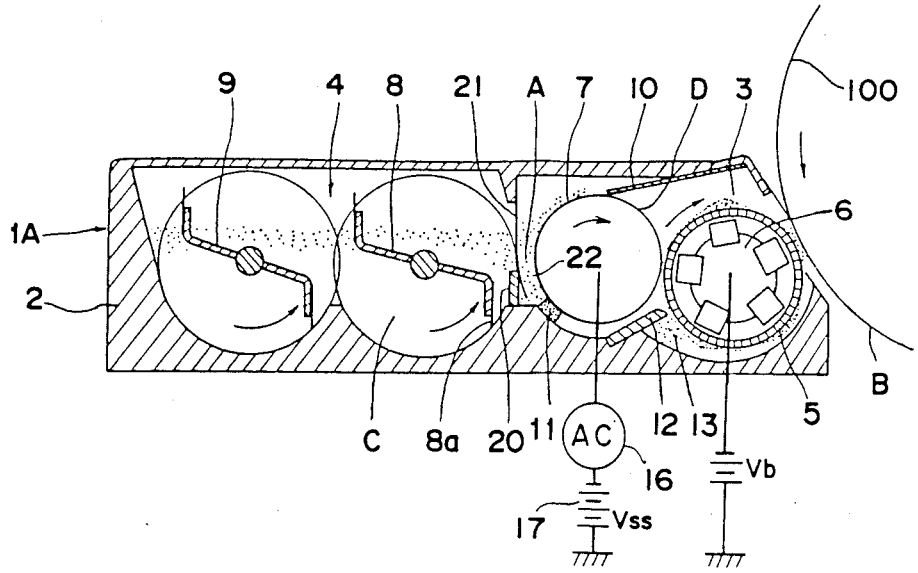
FIGS. 2 and 3 are respectively cross-sectional views of a developing apparatus according to the second embodiment of the present invention.

Next, FIG. 2 shows second embodiment of the developing apparatus according to the present invention. The apparatus 1A is so constructed that, in the developing apparatus 1' shown in FIG. 12, a first partition member 20 and a second partition member 21 are arranged between the toner supplying roller 7 and the agitating member 8. A buffer space 22 is formed among the first partition member 20, the second partition member 21 and the toner supplying roller 7. The first partition member 20 is formed by extending upwardly from part of the bottom of the casing 2.

The second partition member 21 consists of an elastic member fixed to the upper of the casing 2. The lower end of the second partition member 21 extends below the upper end of the first partition member 20 and contacts with the toner supplying roller side surface of the first partition member 20 under pressure.

Therefore, the inside of the toner hopper 4 is divided into a front part and a rear part by the first partition member 20 and the second partition member 21. The buffer space 22 is arranged at the rear of the toner supplying roller 7.

Since the other construction of the developing apparatus 1A is the same as the developing apparatus 1' shown in FIG. 12, it is to be noted that like parts are designated by like reference numerals and symbols throughout the accompanying drawings to omit the description.

Figure 3:
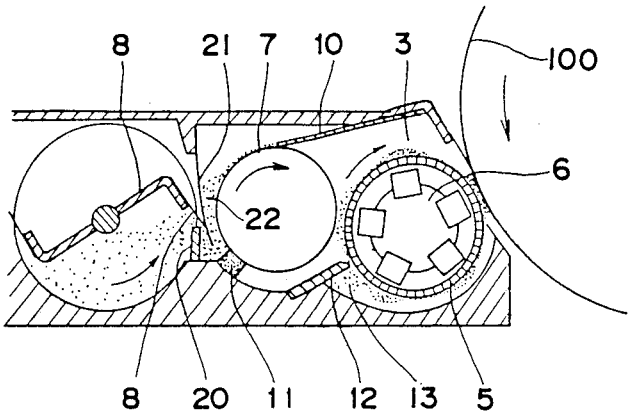

In the developing apparatus 1A, toner positioned at the rear of the first partition member 20 and the second partition member 21 in the toner hopper 4 is forwardly transferred on the basis of rotations of the agitating members 8 and 9. Then, during rotation of the agitating member 8, as shown in FIG. 3, a sheet **8*a* attached to the end of the outer peripheral of the agitating member 8 is pressed on the second partition member 21 to forwardly move it. Thus, toner is replenished into the buffer space 22 through a gap formed between the first partition member 20 and the second partition member 21. The amount of the replenishment of toner is in proportion to the size of the gap formed between the first partition member 20 and the second partition member 21**.

Toner inserted into the buffer space 22 is prevented from flowing out towards the agitating member side of the first partition member 20 and the second partition member 21.

When a lot of toner is held in the buffer space 22, since the space 22 between the toner supplying roller 7 and the second partition member 21 is choked up with toner, the gap is barely formed between the first partition member 20 and the second partition member 21, so that a small amount of toner is inserted into the buffer space 22. Therefore, the apparatus 1A prevents an excessive amount of toner from passing into the buffer space 22.

On the other hand, when a small amount of toner is held in the buffer space 22, since there is a small amount of toner held in the space 22 between the toner supplying roller 7 and the second partition member 21, the size of the gap formed between the first partition member 20 and the second partition member 21 becomes bigger according to rotation of the agitating member 8, so that a lot of toner is replenished into the buffer space 22. Therefore, even if the images formed by consumption of a great amount of toner are continuously formed by a copying operation, a suitable amount of toner corresponding to the consumption of toner can be supplied into the buffer space 22.

Meanwhile, toner in the buffer space 22 is held on the outer circumferential portion of the toner supplying roller 7 on the basis of rotation of the roller 7. Then, the sheet **8*a* of the agitating member 8 periodically contacts with the second partition member 21 under pressure to make the member 21 move forwardly. Thus, toner positioned between the second partition member 21 and the toner supplying roller 7 is pressed on the outer circumferential portion of the toner supplying roller 7**, so that the toner holding power becomes bigger.

Toner held on the outer circumferential portion of the toner supplying roller 7 is regulated by the distal end of the regulating blade 10. Then, after part of toner passes through the vicinity of the distal end of the regulating blade 10 to be supplied to the developing sleeve 5, the toner is mixed with carrier to be used for development. The remainder of toner is scrapped off by the distal end of the regulating blade 10 to be left in the buffer space 22. Then, after the toner is held on the outer circumferential portion of the toner supplying roller 7 at a high probability again, some of toner is supplied to develop and some is left in the buffer space 22 again.

There is a high probability that toner having small grain diameter rather than toner having big grain diameter is held on the outer circumferential portion of the toner supplying roller 7 and passes through the vicinity of the distal end of the regulating blade 10 to be used for development. Therefore, when development operation starts after the toner is inserted in the casing 2, in the beginning, a preference for consumption is given to toner having small grain diameter. Thus, the average grain diameter of toner in the buffer space 22 becomes gradually bigger. Then, as the average grain diameter of toner in the buffer space 22 becomes bigger, the average grain diameter of toner to be used for development becomes bigger. At last, the average grain diameter of toner becomes equal to the average grain diameter of toner supplied from the rear of the first partition member 20 and the second partition member 21 to the buffer space 22. At that time, the average grain diameter of toner inserted into the buffer space 22 balances that of toner flowing out therefrom. That is, though, in the first step of development, a preference for consumption is given to toner having small grain diameter, at last, toner having the average grain diameter equal to that of toner inserted in the casing 2 is used for development.

Figure 4:
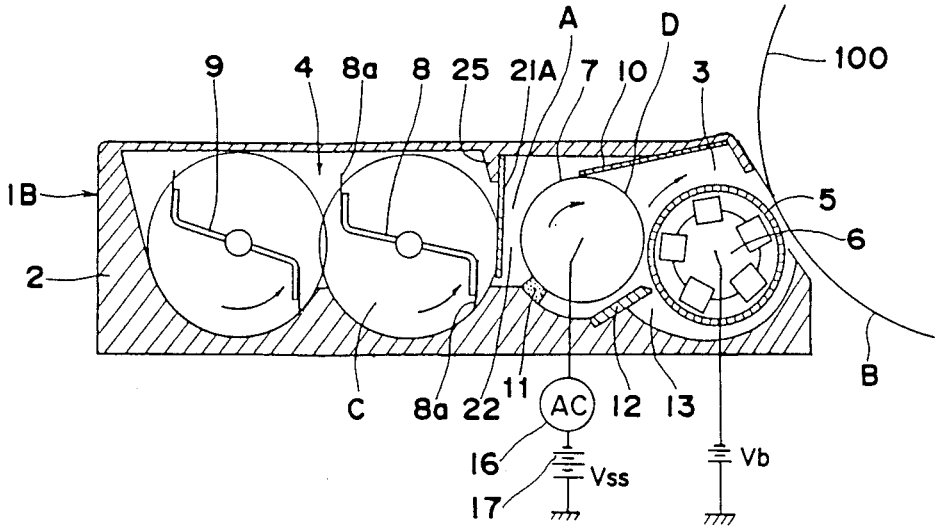
FIGS. 4 and 5 are respectively a cross-sectional view and a perspective view of a developing apparatus according to the third embodiment of the present invention.
Figure 11:
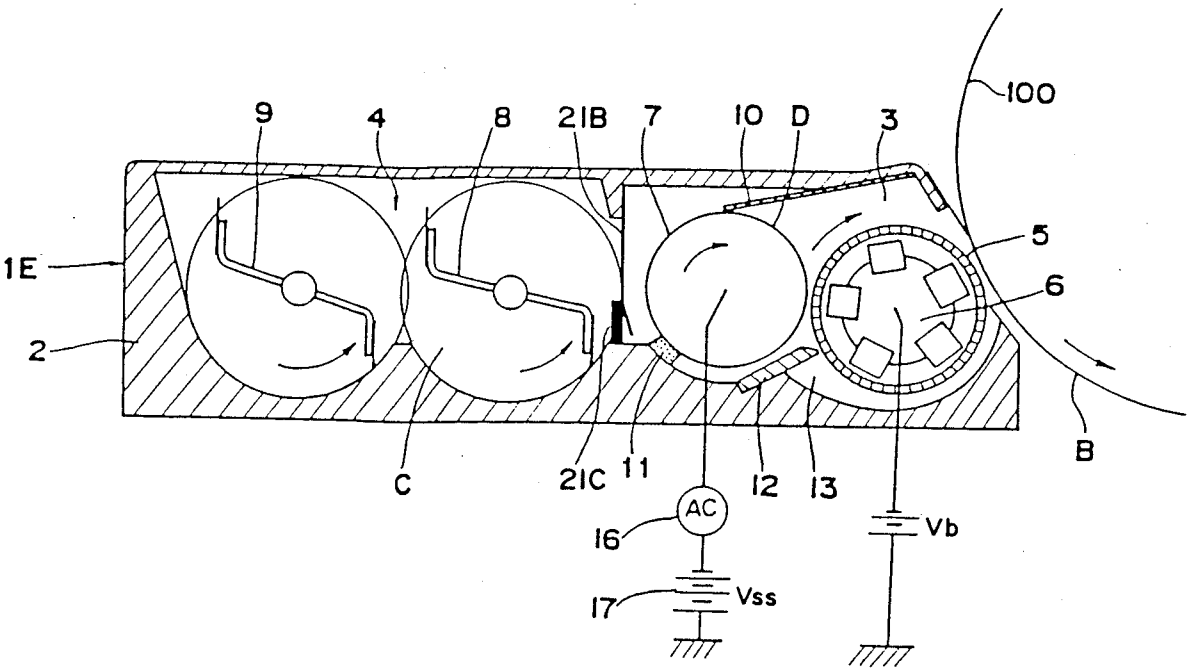
FIG. 11 is a cross-sectional view of a developing apparatus according to further modification of the present invention.

Next, FIG. 4 shows a third embodiment of the developing apparatus according to the present invention. The difference between this apparatus 1B and the developing apparatus 1' shown in FIG. 11 is that an elastic partition member 21A is arranged in the casing 2 and that the end part of the elastic partition member 21A and the end parts of elastic sheets **8*a* attached to the end of the outer circumferential portion of the agitating member 8 are divided into many strips, respectively (see FIG. 5). Since the other construction of the developing apparatus 1B is the same as the developing apparatus 1' shown in FIG. 12**, it is to be noted that like parts are designated by like reference numerals and symbols throughout the accompanying drawings to omit the description.

Figure 5:
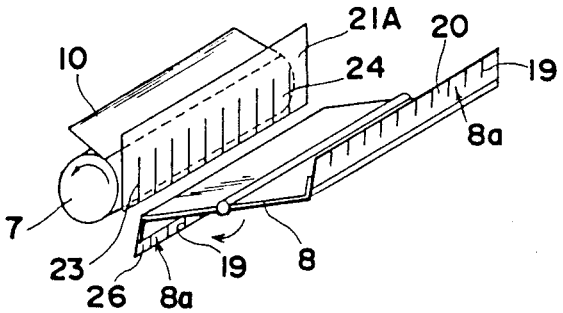

The elastic partition member 21A is arranged between the toner supplying roller 7 and the agitating member 8. The upper of the elastic partition member 21A is fixed to a support portion 25 of the casing 2 and the lower end thereof has a free end. The lower end thereof is constructed in such a form that the support side ends of plural strips 24 are integrally formed. That is, the free end of the lower of the elastic partition member 21A is divided into the strips 24 by the slits 23 extending from the edge of the free end thereof towards the other edge of the end thereof and leaving a specified space between the slits 23, as shown in FIG. 5.

A gap is formed between the free end of the elastic partition member 21A and the bottom of the casing 2. The buffer space 22 is formed between the elastic partition member 21A and the toner supplying roller 7. The buffer space 22 is connected with a space formed behind the elastic partition member 21A through the gap.

On the other hand, each elastic sheet **8*a* of the agitating member 8 is constructed in such form that the support side ends of plural strips 26 are integrally formed. That is, the free end of each elastic sheet 8*a* thereof is divided into the strips 26 by the slits 19 extending from the edge of the free end thereof towards the other edge of the end thereof and leaving a specified space between the slits 19, as shown in FIG. 5**.

In the developing apparatus 1B according to the above-mentioned construction, toner in the toner hopper 4 arranged at the rear of the elastic partition member 21A is subjected to a transferring force to forwardly move it on the basis of rotations of the agitating members 8 and 9. Then, on the basis of rotation of the agitating member 8, the elastic sheets **8*a* of the end thereof make contact with the elastic partition member 21A to forwardly press and to deform it. Thus, toner is pushed into the buffer space 22 through a gap formed between the end of the elastic partition member 21A and the bottom of the casing 2 and a gap formed between the strips 24 respectively by the deformation of the elastic partition member 21A**.

Then, it is because toner in the toner hopper 4 is always urged toward the buffer space 22 by the agitating member 8 that toner in the buffer space 22 is prevented from flowing out towards the rear of the elastic partition member 21A.

Figure 6:
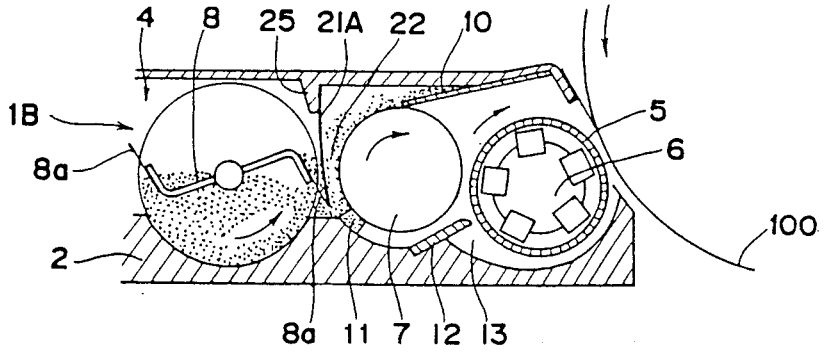
FIGS. 6 and 7 are respectively cross-sectional views of the developing apparatus in a copying operation, according to the third embodiment of the present invention.
Figure 7:
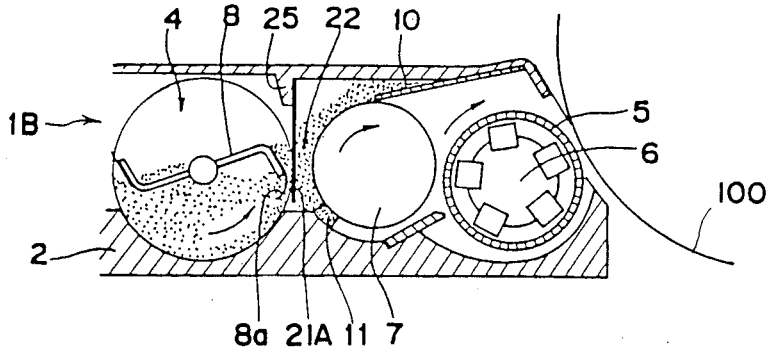

Meanwhile, as shown in FIG. 6, when a small amount of toner is accommodated in the buffer space 22, the amount of the deformation of the elastic partition member 21A is large and a lot of toner is pushed into the buffer space 22. On the other hand, as shown in FIG. 7, when a lot of toner is accommodated in the buffer space 22, the amount of the deformation of the elastic partition member 21A is small and a small amount of toner is pushed into the buffer space 22.

Therefore, when the images formed by consumption of a great amount of toner are continuously formed and a lot of toner is supplied from the buffer space 22 to be used for developing, a lot of toner is pushed into the buffer space 22. Thus, a suitable amount of toner corresponding to the consumption of toner can be supplied into the buffer space 22.

Further, it is because the end part of the elastic partition member 21A is divided into the plural strips 24 that, in the case where toner is partially consumed, the strips 24 corresponding to the place at which toner is partially consumed can deform to replenish toner with the required place in the buffer space 22.

Toner in the buffer space 22 is held on the outer circumferential portion of the toner supplying roller 7 on the basis of rotation of the roller 7. At that time, the elastic sheets **8*a* of the agitating member 8 are periodically pressed on the elastic partition member 21A. Thus, it is because toner positioned between the elastic partition member 21A and the toner supplying roller 7 is pressed on the outer circumferential portion of the toner supplying roller 7 that the toner holding power of the roller 7** increases.

Toner held on the outer circumferential portion of the toner supplying roller 7 is regulated by the distal end of the regulating blade 10. Then, part of toner passes through the vicinity of the distal end of the regulating blade 10 to be supplied to the developing sleeve 5. The supplied toner is used for development. The remainder of toner is scrapped off by the distal end of the regulating blade 10 to be left in the buffer space 22. There is a high probability that the toner left in space 22 is held on the outer circumferential portion of the toner supplying roller 7 again, so that some of toner is used for development and some of toner is left in the buffer space 22 again.

Then, there is a high probability that, in the buffer space 22, toner having small grain diameter rather than toner having big grain diameter is held on the outer circumferential portion of the toner supplying roller 7 and is passes through the vicinity of the distal end of the regulating blade 10 to be used for development. Therefore, when toner is inserted into the casing 2, it is because a preference for consumption is first given to toner having small grain diameter in the buffer space 22 that the average grain diameter of toner therein becomes bigger.

However, when the average grain diameter of toner supplied from the buffer space 22 for development becomes bigger as the average grain diameter of toner in the buffer space 22 becomes bigger and thus equals that of toner transferred from the rear of the elastic partition member 21A to the buffer space 22, that is, that of toner inserted into the toner hopper 4, the average grain diameter of toner inserted into the buffer space 22 balances that of toner flowing out therefrom. That is, though, in the first step of development, a preference for consumption is given to toner having small grain diameter, at last, toner having the average grain diameter which is 14 μm and is inserted in the casing 2 is used for development.

Hereinafter, an experiment of the developing apparatus 1 shown in FIG. 1 is described. The experiment was performed as follows: after toner having the average grain diameter of 14 μm was inserted into the toner hopper 4 in the apparatus 1, the toner was used for development in a copying operation. The grain diameter of toner was measured after each specified number of copied paper at a measured point A in the space 15, a measured point B on the surface of the photosensitive drum 100 after passing through a region confronting the developing sleeve 5, at a measured point C in the toner hopper 4, and a measured point D on the surface of the toner supplying roller 7 after passing through the vicinity of the distal end of the regulating blade 10.

Figure 8:
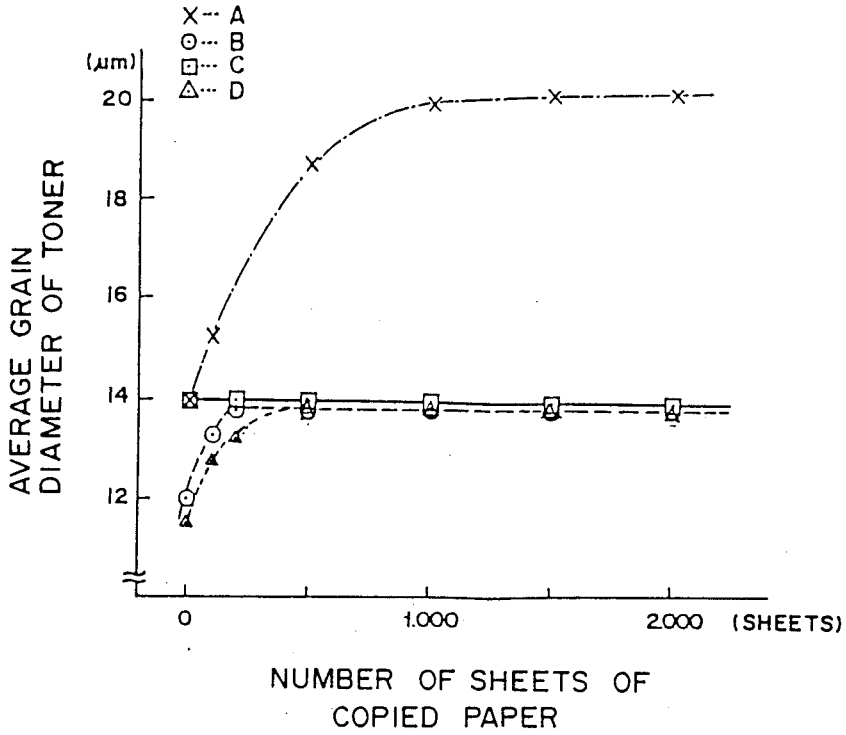
FIG. 8 is a graph of the relation between the number of sheets of copied paper and the average grain diameter of toner, according to the apparatus shown in FIG. 1.

The result of the experiment is shown in FIG. 8. As is clear from the drawing in FIG. 8, at the measured point A in the space 15, the grain diameter of toner increased gradually from the beginning of the copying operation. Then, in the case where the number of sheets of the copied paper reached about 1,000, the grain diameter of toner reached about 20 μm and was stable.

At the measured point D on the surface of the toner supplying roller 7 after passing through the contact region Y and the measured point B on the surface of the photosensitive drum 100 after passing through the region confronting the developing sleeve 5, though each value of the toner average grain diameter measured at the both points D and B was below about 12 μm, the values became gradually stable according to increase of the number of sheets of the copied paper. Then, in the case where the number of sheets of the copied paper reached about 200, the values reached about 14 μm and kept in hereinafter.

Toner was prevented from flowing back into the toner hopper 4 from the space 15 and the value of the toner average grain diameter measured at the measured point C kept that of toner inserted into the toner hopper 4.

The qualities of the images on the copied papers were stably good and recognized no abnormality such as fog in spite of increasing of the number of sheets of the copied paper.

After the number of sheets of the copied paper reached 2,000, new toner having the average grain diameter of 14 μm was replenished the toner hopper 4. But, the average grain diameter of toner measured at each measured point did not change and maintained the value measured before the new toner was inserted thereinto.

Meanwhile, since the second partition member 21 is pressed on the front surface of the first partition member 20 in the second embodiment, the buffer space 22 is completely zoned by the partition member 21 and the first partition member 20. However, it is noted that the second partition member 21 may be designed not to make contact with the first partition member 20. In this case, there is no problem such that toner in the buffer space 22 is prevented from flowing out towards the rear of the second partition member 21 as long as the lower end of the second partition member 21 and the first partition member 20 overlap each other in a vertical direction thereof.

Figure 9:
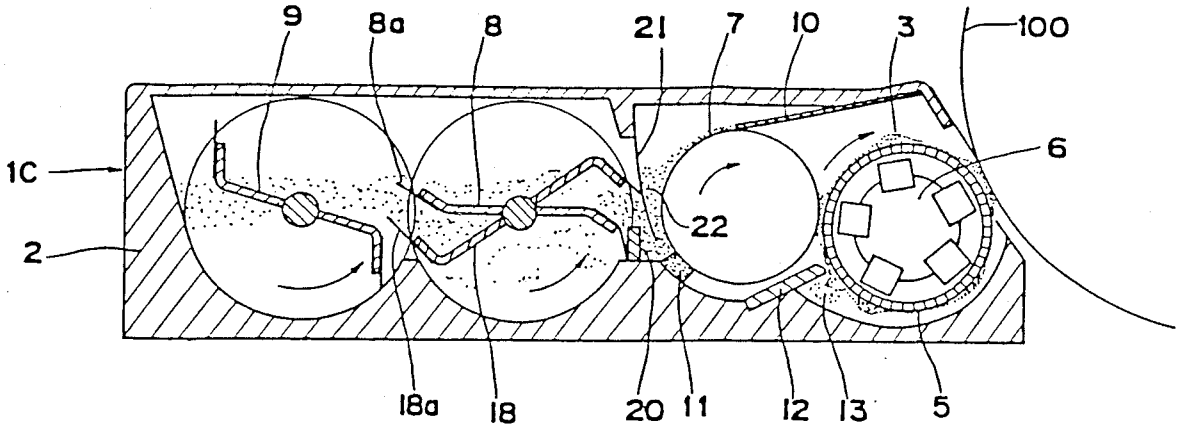
FIG. 9 is a cross-sectional view of a developing apparatus according to a modification of the present invention.

As shown in FIG. 9, if the agitating member 8 of the apparatus 1C has an auxiliary member 18, toner can be held between the agitating member 8 and the auxiliary member 18. In the case, first of all, the second partition member 21 is forwardly pressed to form a gap between the second partition member 21 and the first partition member 20 by the sheets **8*a* of the agitating member 8 positioned upstream to the auxiliary member 18. Then, toner held between the members 8 and 18 is dropped into the buffer space 22 through the gap by the sheets 18*a* of the auxiliary member 18. According to this arrangement, there may be increased the efficiency to be supplied toner into the buffer space 22**.

Furthermore, though, in the above-mentioned arrangement, the sheets **8*a* attached to the distal end of the agitating member 8 are designed to contact with the second partition member 21, the sheets 8*a* do not necessarily make contact with the second partition member 21. The reason is that toner pressed by the sheets 8*a* can make the second partition member 21 deform without direct pressure of the sheets 8*a***.

Figure 10:
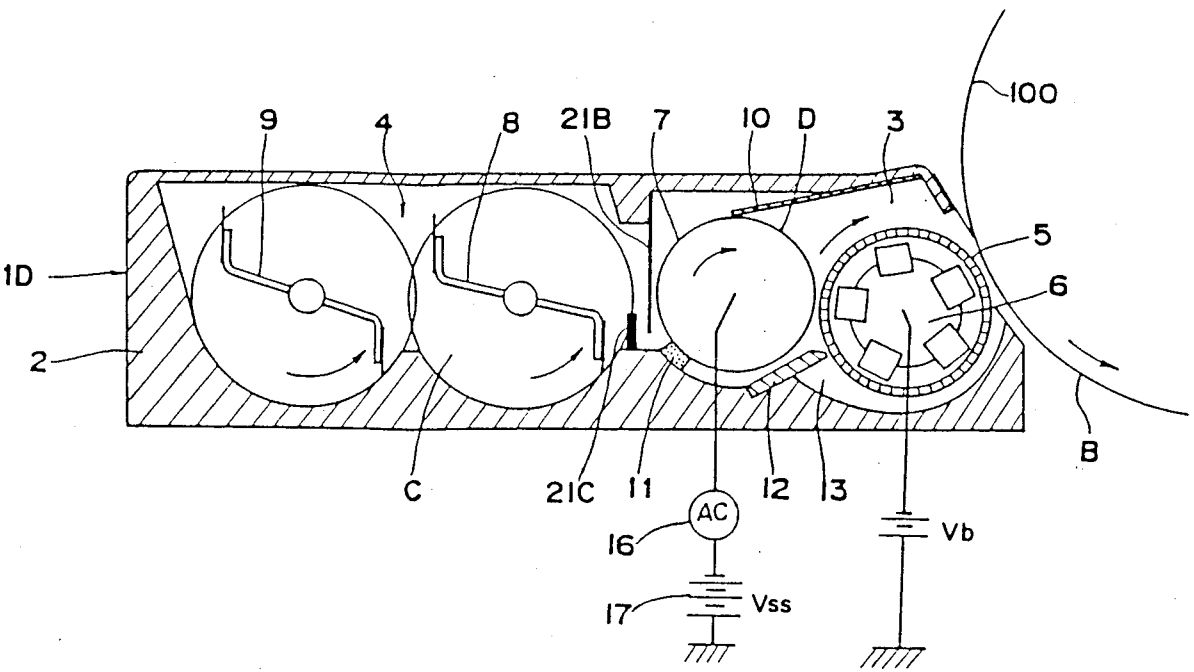
FIG. 10 is a cross-sectional view of a developing apparatus according to another modification of the present invention.

Moreover, apparatus 1D and 1E according to a modification of the third embodiment are shown in FIGS. 10 and 11. In the modification, an elastic partition member 21B is arranged between the toner supplying roller 7 and the agitating member 8. The upper end of the elastic partition member 21B is fixed to the casing 2 and the lower end thereof is divided into plural strips 24. A partition member 21C is arranged to the rear of the partition member 21B, near the agitating member 8. The lower end of the partition member 21C is fixed to the bottom of the casing 2 and the upper end thereof has a free end which extends upward past the lower end of the partition member 21B. The lower end of the partition member 21B either does not make contact with the upper end of the partition member 21C as shown in FIG. 10, or makes contact with the upper end of the partition member 21B, as shown in FIG. 11. In the modification, when the buffer space 22 is choked up with toner, a gap between the partition member 21B and the partition member 21C is small, so that a small amount of toner is supplied to the buffer space 22. On the other hand, when a small amount of toner is in the buffer space 22, the gap between the partition member 21B and the partition member 21C becomes big, so that a lot of toner is supplied to the buffer space 22.

Therefore, it is because the amount of toner corresponding to the amount of toner in the buffer space 22 may be supplied thereto and the partition member 21C prevents toner from flowing out towards the toner hopper 4 behind the buffer space 22 that the apparatus 1D and 1E according to the modification can ensure the effect of the arrangement of the buffer space 22.

Furthermore, though, in the arrangement, the sheets **8*a* of the agitating member 8 are designed to contact with the second partition member 21 under pressure and thus toner in the buffer space 22 is designed to be pushed against the outer circumferential portion of the toner supplying roller 7, the sheets 8*a* of the agitating member 8 may be designed not to make contact with the second partition member 21. In this case, toner is transferred on the basis of rotation of the agitating member 8, so that the second partition member 21 can deform to push toner into the buffer space 22**.

It should be noted that, although the foregoing embodiment has been mainly described with reference to the developing apparatus employing the two-component developing material composed of toner and carrier, the present invention is not limited in its application to such developing apparatus alone, but may be readily applied to developing apparatus using a monocomponent developing material. That is, specifically, the developing apparatus may be so constructed that toner is supplied directly to the outer circumferential portion of the developing sleeve 5 without the toner supplying roller 7 and the regulating blade 10 make contact with the surface of the developing sleeve 5 to regulate the amount of supplied toner.

As is clear from the foregoing description, according to the developing apparatus of the present invention, it is because toner supplied into the space is prevented from flowing out therefrom towards the rear thereof that, though a preference for consumption for development is given to toner having small grain diameter in the beginning of the copying operation, toner having average grain diameter of inserted toner is supplied thereto for development afterward. Therefore, minute and no fog images with good qualities may be obtained by each developing apparatus and the quality of the images does not change even if new toner is replenished in the developing apparatus. Then, the second partition member having elastic capability is urged either directly to the agitating member or indirectly thereto through toner and thus, since toner in the buffer space is actively held the outer circumferential portion of the toner supplying roller, developer can be stably supplied.

Moreover, the moving amount of the second partition member changes in proportion to the amount of toner in the buffer space, and thus, toner corresponding to the consumption of toner is supplied thereto, so that the good quality of the images may be maintained.

Furthermore, even if the developer is partially consumed, the strips corresponding to the place where toner is partially consumed deform to replenish toner with the place. Then, the image density is improved, so that, even if original documents with partial solid are successively copied, an excessive drop of the image density is prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrostatic latent image developing apparatus which comprises:

an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a partition member arranged between said roller member and said agitating member at an upper stream side of said blade corresponding to a rotary direction of said roller member, the casing having a space defined among said partition member, said blade, and the outer circumferential portion of said roller member.

2. An electrostatic latent image developing apparatus as claimed in claim 1, further comprising a developing sleeve confronting said roller member, a developing bias voltage being applied to said developing sleeve, and a bias voltage of biased alternating current being applied to said roller member.

3. An electrostatic latent image developing apparatus which comprises:

a roller member accommodated in a front of a casing, said roller member having an outer circumferential portion thereof contacting with toner, and a blade contacting under pressure with the outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a partition member arranged at an upper stream side of said blade corresponding to a rotary direction of said roller member and having an end contacting with the outer circumferential portion of said roller member, the casing having a space defined among said partition member, said blade and the outer circumferential portion of said roller member arranged between said partition member and said blade, and toner held on the outer circumferential portion of said roller member permitting to flow in said space on the basis of rotation of said roller member, while toner in said space is prevented from flowing out therefrom.

4. An electrostatic latent image developing apparatus as claimed in claim 3, further comprising a developing sleeve confronting the roller member, a developing bias voltage being applied to said developing sleeve, and a bias voltage of biased alternating current being applied to said roller member.

5. An electrostatic latent image developing apparatus which comprises:

an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising a first partition member and a second partition member respectively arranged between said roller member and said agitating member, said first partition member having a free end at an upper end thereof, and said second partition member having elasticity and including an upper end fixed to an upper portion of the casing and a free end at a lower portion thereof which extends lower than the upper portion of said first partition member at a roller member side of said first partition member.

6. An electrostatic latent image developing apparatus as claimed in claim 5, further comprising a developing sleeve confronting the roller member, a developing bias voltage being applied to said developing sleeve, and a bias voltage of biased alternating current being applied to said roller member.

7. An electrostatic latent image developing apparatus as claimed in claim 5, wherein an elastic sheet divided into plural strips is provided at an end of said agitating member.

8. An electrostatic latent image developing apparatus as claimed in claim , further including a second agitating member which is the same as said first-mentioned agitating member.

9. An electrostatic latent image developing apparatus as claimed in claim 8, each agitating member being driven to rotate in the same direction.

10. An electrostatic latent image developing apparatus which comprises:

an agitating member accommodated in a casing, a roller member accommodated in a front of the casing, and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade, said apparatus comprising an elastic partition member arranged between the roller member and the agitating member and having an upper end thereof fixed to the casing and a lower end which is a free end divided into strips.

11. An electrostatic latent image developing apparatus as claimed in claim 10, further comprising a developing sleeve confronting the roller member, a developing bias voltage being applied to said developing sleeve, and a bias voltage of biased alternating current being applied to said roller member.

12. An electrostatic latent image developing apparatus as claimed in claim 10, wherein an elastic sheet divided into plural strips is provided at an end of said agitating member.

13. An electrostatic latent image developing apparatus as claimed in claims 10, further including a second agitating member which is the same as said first-mentioned agitating member.

14. An electrostatic latent image developing apparatus as claimed in claim 13, each agitating member being driven to rotate in the same direction.

15. An electrostatic latent image developing apparatus which comprises:

an agitating member accommodated in a casing;

a roller member accommodated in front of the casing; and a blade contacting under pressure with an outer circumferential portion of said roller member, which is arranged in the casing, toner held on the outer circumferential portion of said roller member being supplied to develop an electrostatic latent image on the basis of rotation of said roller member while being regulated by said blade;

said apparatus comprising a first partition member and a second partition member respectively arranged between said roller member and said agitating member, said first partition member having a free end and an upper end thereof, said second partition member having elasticity and including an upper end fixed to an upper portion of the casing and a free end at a lower portion thereof which extends lower than the upper portion of said first partition member at a roller member side of said first partition member, said second partition member being divided into strips.

16. An electrostatic latent image developing apparatus as claimed in claim 15, further comprising a developing sleeve confronting the roller member, a developing bias voltage being applied to said developing sleeve, and a bias voltage of biased alternating current being applied to said roller member.

17. An electrostatic latent image developing apparatus as claimed in claim 15, wherein an elastic sheet divided into plural strips is provided at an end of said agitating member.

18. An electrostatic latent image developing apparatus as claimed in claims 15, further including a second agitating member which is the same as said first-mentioned agitating member.

19. An electrostatic latent image developing apparatus as claimed in claim 18, each agitating member being driven to rotate in the same direction.

20. An electrostatic latent image developing apparatus comprising:

an agitating member accommodated in a casing;

a roller member accommodated in a front of the casing;

a blade contacting under pressure with an outer circumferential portion of said roller member, which is arranged in the casing, only toner held on the outer circumferential portion of said roller member being supplied to develop an electrostatic latent image on the basis of rotation of said roller member while being regulated by said blade; and a partition member arranged between said roller member and said agitating member at an upper stream side of said blade corresponding to a rotary direction of said roller member, the casing having a space defined among said partition member, said blade, and the outer circumferential portion of said roller member.

21. An electrostatic latent image developing apparatus as claimed in claim 20, further comprising a developing sleeve confronting the roller member, a developing bias voltage being applied to said developing sleeve, and a bias voltage of biased alternating current being applied to said roller member.

22. An electrostatic latent image developing apparatus, comprising:

a roller member accommodated in a front of a casing, said roller member having an outer circumferential portion thereof in contact with toner material;

a blade contacting under pressure with the outer circumferential portion of said roller member, which is arranged in the casing, only toner held on the outer circumferential portion of said roller member being supplied to develop an electrostatic latent image on the basis of rotation of said roller member while being regulated by said blade; and a partition member arranged at an upper stream side of said blade corresponding to a rotary direction of said roller member and having an end contacting with the outer circumferential portion of said roller member, the casing having a space defined among said partition member, said blade, and the outer circumferential portion of said roller member arranged between said partition member and said blade, and toner held on the outer circumferential portion of said roller member permitting to flow in said space on the basis of rotation of said roller member, while toner in said space is prevented from flowing out therefrom.

23. An electrostatic latent image developing apparatus as claimed in claim 22, further comprising a developing sleeve confronting the roller member, a developing bias voltage being applied to said developing sleeve, and a bias voltage of biased alternating current being applied to said roller member.

* * * * *